United States Patent [19]

Reynolds et al.

[11] 4,440,614

[45] Apr. 3, 1984

[54] INLET END BOX BRINE PIPE BAFFLE

[75] Inventors: Don E. Reynolds; James F. Pickering, both of Athens, Tenn.

[73] Assignee: Olin Corporation, New Haven, Conn.

[21] Appl. No.: 550,438

[22] Filed: Nov. 10, 1983

[51] Int. Cl.[3] ..... C25B 1/40; C25B 9/00; C25B 15/08

[52] U.S. Cl. ..... 204/219; 204/220; 204/250

[58] Field of Search ..... 204/99, 219–220, 204/250, 275, 279

[56] References Cited

U.S. PATENT DOCUMENTS

| | | | |
|---|---|---|---|
| 3,445,373 | 5/1969 | Schücker et al. | 204/250 X |
| 3,560,355 | 2/1971 | Shibata et al. | 204/219 X |
| 3,575,837 | 4/1971 | Shibata et al. | 204/220 |
| 4,152,237 | 5/1979 | McAllister et al. | 204/219 |

FOREIGN PATENT DOCUMENTS

| | | | |
|---|---|---|---|
| 49-37640 | 10/1974 | Japan | 204/219 |

*Primary Examiner*—Donald R. Valentine
*Attorney, Agent, or Firm*—Ralph D'Alessandro; Donald F. Clements; Thomas P. O'Day

[57] ABSTRACT

In a flowing mercury cathode electrolytic cell for the electrolysis of aqueous solutions there is provided an improved brine flow baffle insertable into the brine inlet trough.

6 Claims, 8 Drawing Figures

INLET END BOX BRINE PIPE BAFFLE

BACKGROUND OF THE INVENTION

This invention relates generally to flowing mercury cathode electrolytic cells and, more specifically, to an improved flow baffle that is insertable into the brine inlet trough.

Flowing mercury cathode electrolytic cells have been employed for a substantial number of years to produce chlorine and caustic throughout the world. Electrolytic cells are generally used to decompose solutions of alkali metal compounds. In the flowing mercury type of electrolytic cell, a mercury cathode is provided which flows along the bottom of the cell. A plurality of anodes are usually composed of plate-like elements supported from above with their surfaces parallel to the surface of the flowing mercury and spaced a short distance above the flowing mercury.

This distance between the anodes and the cathode in a flowing mercury cathode type of electrolytic cell is important since the inter-electrode distance should be as small as possible to reduce the consumption of energy required to accomplish the electrolysis. However, if the distance is too small between the anodes and the cathodes, secondary reactions may occur which reduce the efficiency of the cell.

Short circuits are a substantial problem in flowing mercury cathode type of electrolytic cells and are a source of this undesirable reduction in cell efficiency. Any direct contact between the anodes and the flowing mercury cathodes will form a short circuit. This short circuiting can burn-out the anodes where such cathode-anode contact occurs.

In a flowing mercury cathode type of electrolytic cell an aqueous solution of an alkali metal halide, such as for example, sodium chloride, flows through the cell and immerses the anodes and part of the anode supporting structure. A thin layer of the solution occupies the space between the upper surface of the flowing mercury cathode and the bottom surface of the anode. DC current passes through the anodes, through this thin layer of the aqueous solution of the alkali metal compound and to the mercury cathode, which is at the bottom of the cell. This flow of current provides the energy to generate the product chlorine gas.

This aqueous solution of the alkali metal halide is normally called brine. The brine is sent into the electrolytic cell through an inlet trough adjacent one end of the cell box. This trough is near the flowing mercury cathode on the bottom of the cell and the initial suspended anodes. If the flow rate and path of brine into the cell is not controlled, the brine can create turbulence in the flowing mercury cathode which can cause the mercury to splatter onto the anode surfaces immediately above the cathode. This, then, results in the short circuiting problem.

Prior efforts, such as that described in U.S. Pat. No. 4,152,237 of McAllister et al and assigned to the assignee of the present invention, have attempted to solve this problem by controlling the flow rate of brine into the cell box. This has proven unsuccessful, however, since splashing of the flowing mercury cathode still occurs because of the velocity of the infed brine. When this splashing occurs and contact is made with the anodes which are suspended overhead, the anodes are prematurely eaten away because of the short circuiting.

This is especially a problem for the first or inlet set of anodes nearest the inlet ,; brine trough.

Also, a "ripple effect" in the mercury is caused by the turbulent manner in which the inlet brine flows into the cell. This rippling along the top surface of the flowing mercury varies the distance between the individual anodes and the flowing mercury cathode along the length of the cell, thereby varying the optimum inter-electrode distance. This less than optimum inter-electrode distance thereby increases power costs during the operation of the cell. One solution to this "ripple effect" problem has been to increase the inter-electrode gap. However, this then further increases the power cost of the operation of the cell, especially when the automatic adjusters used in some commercial mercury cells raise all of the anodes, normally 10 or 12 sets or channels, and not just the initial set adjacent the inlet brine trough.

The foregoing problems are solved in the design of the apparatus comprising the present invention.

SUMMARY OF THE INVENTION

It is a principal object of the present invention to provide in a flowing mercury cathode type of electrolytic cell an improved inlet end box or brine trough baffle to reduce brine splashing as brine enters the inlet channel in the electrolytic cell box.

It is another object of the present invention to provide an improved inlet brine trough baffle that permit the inlet anode settings to be lowered to reduce the inter-electrode gap.

It is a feature of the present invention that the improved baffle is in the form of an elongate tubular pipe that seats within the inlet brine trough.

It is another feature of the present invention that the elongate tubular pipe or baffle has a full circumference in the center section immediately above the inlet feed funnel in the bottom of the inlet brine trough.

It is still another feature of the present invention that the elongate tubular pipe or baffle has an interrupted circumference on the sides adjacent the area of full circumference so that grooves or slits extend out to the side of the fully closed portion in the center section on the lower side or lower circumference adjacent the inlet feed funnel.

It is still another feature of the present invention that the elongate tubular pipe or baffle has an intermediate area of interrupted circumference on the top side or upper circumference with elongate grooves or slits to permit the brine to flow out into the inlet channel in the cell box.

It is yet another feature of the present invention that the flow of brine through the baffle enters through the bottom and is deflected out of the top initially away from the cell box and the anodes.

It is an advantage of the present invention that the improved baffle stops splashing of the brine out of the inlet brine trough into the channel and prevents the resultant splattering of the flowing mercury cathode onto the anodes.

It is another advantage of the present invention that there are improved hydraulic flow characteristics achieved in the electrolytic cell present so that no splashing of the brine occurs.

It is a further advantage of the present invention that the set point voltage coefficient of the inlet set of anodes in the flowing mercury cathode type of electrolytic cell may be reduced.

It is still another advantage of the present invention that reduced power consumption is achieved during the operation of the cell.

It is still another advantage of the present invention that the flow of inlet brine into the inlet brine trough is spread out across the width of the brine trough so as to prevent splashing of the brine.

These and other objects, features and advantages are obtained in a flowing mercury cathode type of electrolytic cell wherein an improved flow baffle means is provided that is generally elongate and tubular between a first end and an opposing second end having an upper circumference and a lower circumference, the lower circumference having a fully closed portion in the area overlying the inlet flow funnel and interrupted portions on adjacent sides of the fully closed portion with at least one opening on each side extending outwardly to the first and second opposing ends, the upper circumference being fully closed for a portion in an area intermediate the first end and the opposing second end, but interrupted on adjacent sides of the fully closed portion.

BRIEF DESCRIPTION OF THE DRAWINGS

The advantages of this invention will become apparent upon consideration of the following detailed disclosure of the invention, especially when it is takenn conjunction with the accompanying drawings wherein.

DETAILED DESCRIPTION OF THE PREFERRED EMBODIMENT

Figure 1:
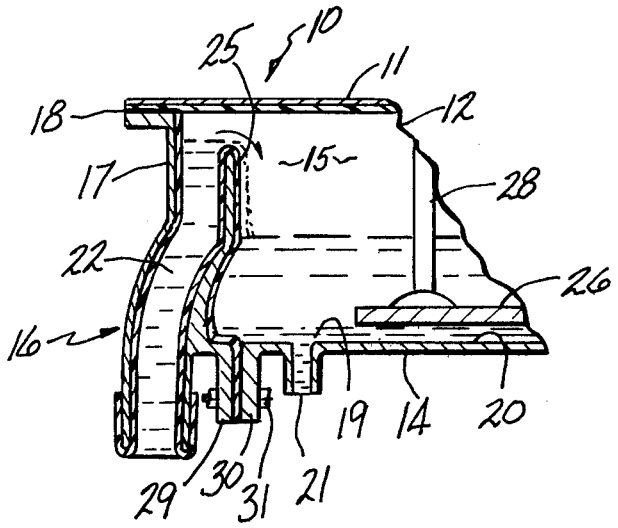
FIG. 1 is a partial sectional view of a flowing mercury cathode type of electrolytic cell of the general type in which the subject invention is employed, but without the improved pipe baffle shown.

FIG. 1 is a partial sectional view of a conventional flowing mercury cathode type of electrolytic cell, indicated generally by the numeral 10. Mercury cell 10 has a cell cover 11 which fits atop the cell box 12. Cell box 12 has a cell bottom 14 and opposing sides 15 (only one of which is shown). On one end of the cell box 12 there is attached a brine inlet trough means, indicated generally by the numeral 16. A rubber gasket 18 is placed between the cell cover 11, the brine inlet trough means 16, as well as between where the brine inlet trough means 16 is joined to the cell bottom 14.

Cell 10 has a flowing mercury cathode 19 that rests atop the upper surface of the cell bottom 20. Mercury flows into the cell box 12 through a mercury inlet 21. The electrolyte or brine solution 22 enters the inlet brine trough means 16 through an inlet flow funnel 24, best seen in FIG. 2. The brine solution 22 then passes through the appropriate apertures or slits in the flow baffle means to pass out into the outer side 17 of trough means 16 and then over the side 25 of the brine inlet trough means into the cell box 12. This flow into the cell box 12 is shown by the arrow in FIG. 1. The brine mixes with the existing electrolyte to immerse the anodes 26 (only one of which is partially shown) and a portion of the anode posts 28 (a portion of only one of which is shown). The inlet brine trough means 16 is fastened to the cell box 12 by means of flanges 29 and 30 and nut and bolt combinations 31.

Figures 2, 3, 4, 5, 8:
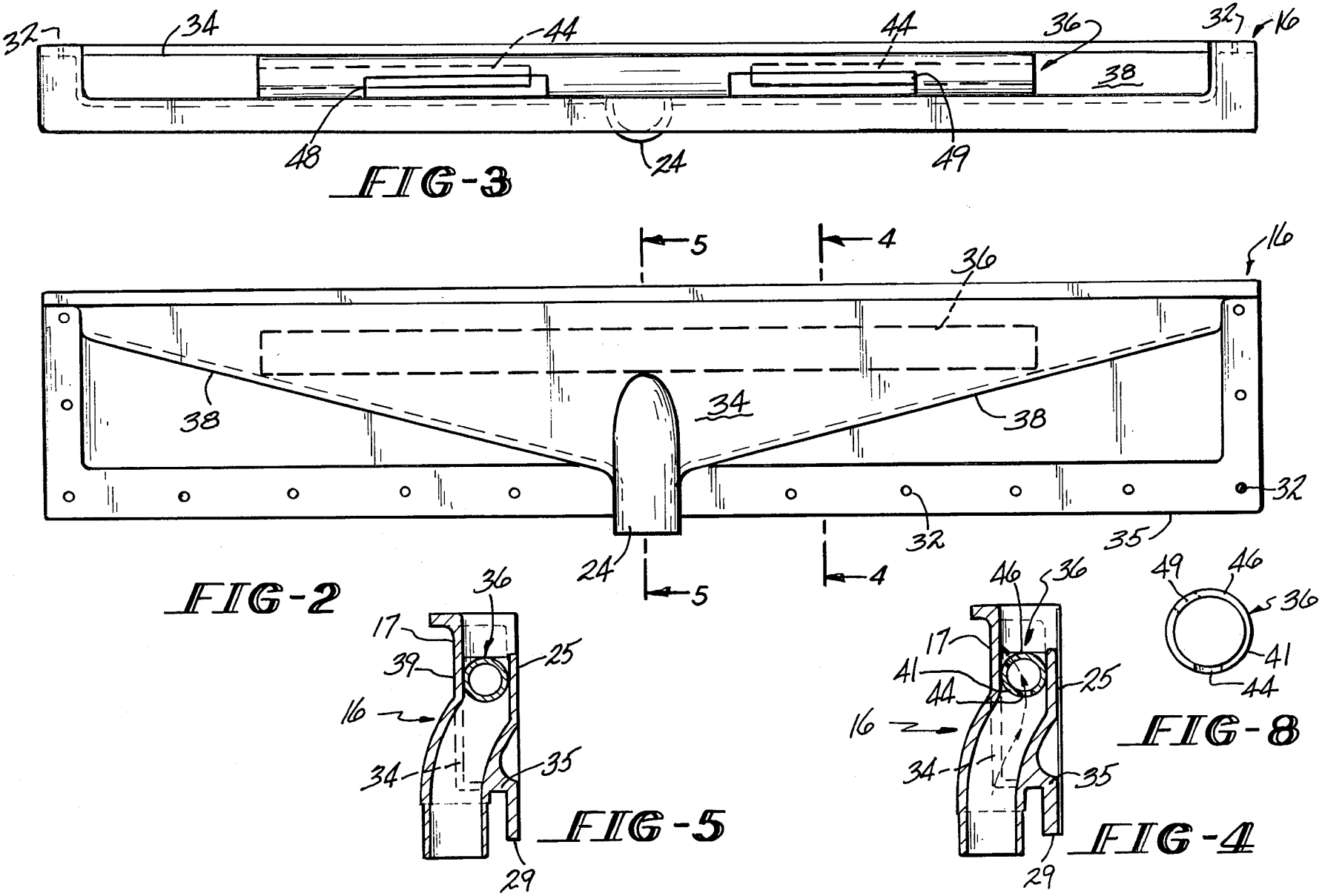
FIG. 2 is a side elevational view of the inlet brine trough with the improved pipe baffle shown in phantom lines.
FIG. 3 is a top plan view of an inlet brine trough with the improved pipe baffle shown.
FIG. 4 is a sectional view taken along the lines 4—4 of FIG. 2.
FIG. 5 is a sectional view taken along the lines 5—5 of FIG. 2.
FIG. 8 is an enlarged side elevational view of the improved pipe baffle as seen in FIG. 4.

As best seen in FIGS. 2 and 3, brine inlet trough means 16 is secured to the cell box 12 by a plurality of bolts (not shown) inserted through the appropriate sized apertures 32. A trough portion 34 is formed by a portion that extends outwardly from the base portion 35 of brine inlet trough means 16. The improved baffle means 36 is placed in the trough portion 34 so that the baffle means 36 rests on the angled sides 38 of the sides of the trough portion 34.

Figure 6:
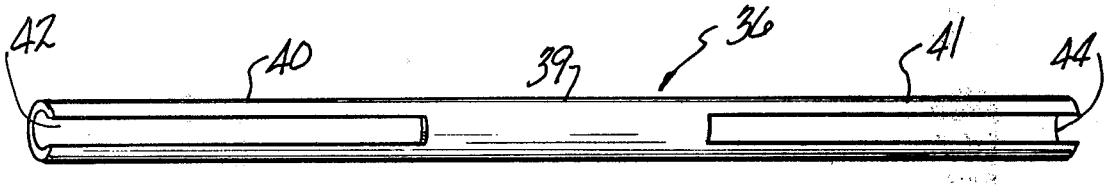
FIG. 6 is a perspective view of the lower circumference of the improved pipe baffle.
Figure 7:
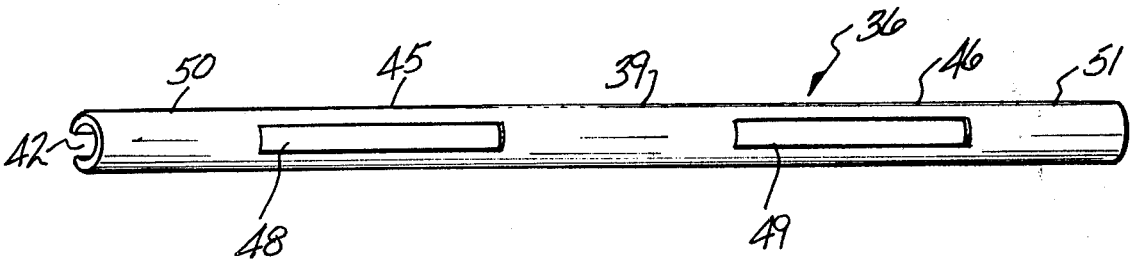
FIG. 7 is a perspective view of the lower circumference of the improved pipe baffle.

FIGS. 6 and 7 show the improved baffle means 36 as seen from the bottom or lower circumference and the upper circumference, respectively. As seen in both FIGS. 6 and 7, the improved baffle means 36 has a fully closed central portion 39 that circumnavigates the entire periphery to form a center section of full circumference with the control portion 39 of the upper and lower circumference. The lower circumference, as seen in FIG. 6, shows that there are interrupted portions 40 and 41 on adjacent sides of the fully closed portion 39. The interrupted portions 40 and 41 are defined by elongate grooves or slits 42, 44 that extend outwardly from the central portion 39 to the opposing first and second ends of the generally elongate tubular pipe baffle means 36. As seen in FIG. 7, the top side or upper circumference of the improved baffle means 36 also presents the fully closed portion 39 with interrupted portions 45 and 46 defined by slits 48 and 49, respectively, immediately adjacent thereto. Outwardly of the slits 48 and 49 on the upper circumference are closed end portions 50 and 51.

The improved baffle means 36 is placed in the trough portion 34 of the brine inlet trough means 16 as previously described. It is secured in place by the use of an appropriate adhesive, such as rubber cement with an appropriate hardner Rubber stoppers or other retainers inserted in the ends of the pipe to prevent the flow of brine outwardly therethrough. The rubber stoppers (not shown) or other appropriate means also assist in preventing the improved baffle means from shifting laterally.

The improved baffle means 36 are seen in sectional views in FIGS. 4 and 5. FIG. 4 shows the improved baffle means 36 along the section lines 4—4 of FIG. 2 wherein the interrupted portions 41 and 46 of the lower and upper circumferences, respectively, can be seen with the grooves or slits 44 and 49 shown, respectively. FIG. 8 shows an enlarged view of just the improved baffle means 36 of FIG. 4.

FIG. 5 shows a sectional view of the brine inlet trough means 16 with the improved baffle means 36 taken along the lines 5—5 of FIG. 2. This illustrates how the center section or central portion of the improved baffle means is fully closed about its entire or full circumference by the fully closed portion 39.

It should be noted that the slits 48 and 49 are offset from the vertical. This is best seen in FIGS. 4 and 8 where a groove or slit 49 can be seen. Grooves or slits 42 and 44 are positioned to lie in a generally vertical plane over the inlet brine flow funnel 24 outwardly of the fully closed portion 39 on the lower circumference.

Thus, when brine is fed into the inlet brine funnel 24 it passes upwardly, striking the fully closed portion 39 of the baffle means 36. The brine solution 22 is then deflected outwardly from the fully closed portion 39 toward the opposing first and second ends of the baffle means 16 until it enters the grooves or slits 42 and 44. This then permits the brine solution to disperse itself along generally the full length of the improved baffle means 36.

The brine solution 22 continues its upward movement, as illustrated by the arrows in FIG. 4, until it passes outwardly through the slits 48 and 49 in the upper circumference. This creates a directional movement that deflects the flow of brine solution 22 away from the cell box 12 and into the outer side 17 of the brine trough 16. In order to pass over the side 25 of brine inlet trough means 16, the brine solution 22 level must exceed the top of side 25. The brine solution 22 must also change direction, thus dissipating some of its velocity. The diffusion of the brine solution 22 along the length of the brine inlet trough means 16 prevents brine solution 22 from splashing over the side 25 at one localized area and prevents the splattering of the flowing mercury cathode 19 up into the anodes 26. This diffusion of the brine solution 22 also substantially reduces the turbulence of the electrolyte in the cell box 12 and, thus, reduces the "ripple effect" on the flowing mercury cathode 19. The inter-electrode gap between the flowing mercury cathode and the inlet set of anodes is thus maintained at the optimum distance and, in fact, can be at the same gap distance as the remaining sets of anodes - flow mercury cathode gaps.

The improved baffle means 36 permits the flowing mercury cathode electrolytic type of cell to operate more efficiently by lowering the inlet anode setting to the normal position as it is controlled by an anode adjusting computer mechanism, utilizing the voltage coefficients as the determining factor in the settings. By setting or selecting the desired voltage coefficient for each anode setting on the computer, the anode adjusting computer mechanism sets the proper anode-flowing mercury cathode inter-electrode gap. This is opposed to the inlet anode setting which heretofore had to be maintained at greater distance above the flowing mercury cathode because of the splashing of the mercury created by the turbulence of the inlet brine flow and the resultant short circuits that occur when the flowing mercury cathode contacts the anode.

The voltage coefficient is used as the determining factor in the settings of the inter-electrode gaps because it is a measure of power consumption in the operating mercury cell. This voltage coefficient is given by the equation:

$$\text{voltage} = E^{O} + \text{V.C. (C.D.)}$$

where the voltage is the cell operating voltage, $E^{O}$ is the theoretical decompositon voltage of the sodium chloride brine solution, V.C. is the voltage coefficient expressed in $V/ka/m^2$ and C.D. is the operating current density expressed in $ka/m^2$. This equation is an expression of the actual operating cell voltage necessary to produce chlorine.

Within a flowing mercury type of electrolytic cell each anode set with its anodes operates with a separate and distinct voltage coefficient. The total of all anode sets then are combined to give a cell operating voltage coefficient. But the computer adjusting mechanism only adjusts individual anode sets with the multiple individual anodes in each set. Typically, the mercury cell 10 may have 5 or 8 anodes in each anode set spanning the length of the brine inlet trough means 16. The improved baffle means 36 of the present invention has permitted the inlet anode channel voltage coefficient or set point to be reduced from 0.145 $V/ka/m^2$ to approximately 0.125 $V/ka/m^2$.

In order to illustrate the results achieved with the improved baffle means 16 of the instant invention utilized in a flowing mercury type of electrolytic cell, the following example is provided without any intent to limit the scope of the instant invention to the discussion therein.

EXAMPLE

A flowing mercury cathode type of electrolytic cell was operated with 12 sets of anodes in 8 channels or rows, otherwise known as an E-812 mercury cell. With the conventional prior art flow baffle, the previous inlet anodes voltage coefficient set point utilized in the computer adjusted anodes was 0.145 $V/ka/m^2$. The cell was operated with an average load of 178 kiloamperes and an average brine temperature of 68.5° C. The average brine concentration was 280 gpl NaCl. The average composition by weight of the sodium amalgam that passed out of the electrolyzer cell box through the outlet to the decomposer was 0.221% by weight sodium. The anodes were metal of the rod type with a ruthinium dioxide - titanium dioxide composition. The voltage coefficient set point for the inlet anode setting was 0.120 $V/ka/m^2$. No damage occurred to the inlet set of anodes.

While the preferred structure in which the principles of the present invention have been incorporated is shown and described above, it is to be understood that the invention is not to be limited to the particular details thus presented. In fact, widely different means may be employed in the practice of the broader aspects of this invention. The scope of the appended claims is intended to encompass all obvious changes in the details, materials and arrangements of parts which will occur to one of skill in the art upon the reading of the disclosure.

What is claimed is:

1. In a flowing mercury cathode electrolytic cell for the electrolysis of aqueous solutions to produce at least one product gas and a product hydroxide having a cell box with a cathodic conducting insulated side walls, and an insulated and removable top, brine inlet trough means having a first side and an outer side, the brine inlet trough means further having an inlet flow funnel and opposing ends, product outlet means, adjustable anodes and electrical current conducting means, the improvement comprising:

an improved flow baffle means insertable into the brine inlet trough means, the flow baffle means being elongate and generally tubular between a first end and an opposing second end having an upper circumference and a lower circumference, the lower circumference having a fully closed portion in the area overlying the inlet flow funnel and interrupted portions on adjacent sides of the fully closed portion with at least one opening on each side extending outwardly to the first and second opposing ends, the upper circumference being fully closed for a portion in an area intermediate the first end and the opposing second end and being interrupted on adjacent sides of the fully closed portion with at least one opening on each side intermediate the fully closed portion of the upper circumference and the first end and the second opposing end, respectively, the upper circumference further being fully closed adjacent the first end and the opposing second end.

2. The apparatus according to claim 1 wherein the improved baffle means is further sealed in the brine inlet trough means by sealing means between the first and opposing second end to prevent the passage of brine therearound.

3. The apparatus according to claim 2 wherein the at least one opening on each side of the fully closed portion of the lower circumference further comprises first elongate grooves in the interrupted portions on adjacent sides of the fully closed portion.

4. The apparatus according to claim 3 wherein the at least one opening on each side intermediate the fully closed portion of the upper circumference and the first end and the second opposing end further comprises second elongate grooves.

5. The apparatus according to claim 4 wherein the flow of brine through the brine inlet trough means and the improved flow baffle means is upward and rearward through the first elongate grooves and the second elongate grooves toward the outer side of the brine inlet trough.

6. The apparatus according to claim 5 wherein the flow of brine must change direction after exiting the improved flow baffle means prior to entering the cell box.

* * * * *

UNITED STATES PATENT AND TRADEMARK OFFICE

CERTIFICATE OF CORRECTION

PATENT NO. : 4,440,614

DATED : April 3, 1984

INVENTOR(S) : Don E. Reynolds, James F. Pickering

It is certified that error appears in the above-identified patent and that said Letters Patent is hereby corrected as shown below:

Column 2, line 2, after "inlet" and before "brine" delete ",;".

Column 3, line 26, delete "takenn" and insert -- taken in --.

Column 3, line 43, delete "lower" and insert -- upper --.

Column 6, Claim 1, line 48, after "conducting" and before "insulated" insert -- bottom,--.

Signed and Sealed this

*Twentieth* Day of *November 1984*

[SEAL]

*Attest:*

*Attesting Officer*

GERALD J. MOSSINGHOFF

*Commissioner of Patents and Trademarks*